US005564567A

United States Patent [19]

Weder

[11] Patent Number: 5,564,567

[45] **Date of Patent: *Oct. 15, 1996**

[54] METHOD FOR TRANSPORTING FLORAL GROUPINGS

[75] Inventor: Donald E. Weder, Highland, Ill.

[73] Assignees: Southpac Trust International, Inc.; The Family Trust U/T/A, both of Oklahoma City, Okla.

[ * ] Notice: The term of this patent shall not extend beyond the expiration date of Pat. No. 5,407,072.

[21] Appl. No.: 242,485

[22] Filed: May 13, 1994

Related U.S. Application Data

[63] Continuation-in-part of Ser. No. 202,058, Feb. 25, 1994, Pat. No. 5,411,137, which is a continuation of Ser. No. 93,109, Jul. 16, 1993, Pat. No. 5,311,992, which is a continuation-in-part of Ser. No. 892,441, Jun. 2, 1992, Pat. No. 5,240,109, which is a continuation of Ser. No. 831,767, Feb. 5, 1992, Pat. No. 5,148,918, which is a continuation-in-part of Ser. No. 692,329, Apr. 26, 1991, Pat. No. 5,092,465.

[51] Int. Cl.[6] ..... B65D 85/52

[52] U.S. Cl. ..... 206/423; 47/84; 53/473; 206/460; 206/813; 414/786

[58] Field of Search ..... 206/423, 460, 206/813; 53/397, 399, 410, 458, 473; 47/72, 84; 414/786

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren | 206/80 |
| 2,373,634 | 4/1945 | Wagner | 117/122 |
| 2,578,583 | 12/1951 | O'Brien | 206/65 |
| 2,664,670 | 1/1954 | Mulford | 206/423 |
| 2,707,352 | 5/1955 | Fischer | 47/58 |
| 2,744,624 | 5/1956 | Hoogstoel et al. | 206/65 |
| 2,871,080 | 1/1959 | Shelly | 312/107 |
| 3,113,673 | 12/1963 | Stein | 206/65 |
| 3,389,784 | 6/1968 | Hendricks et al. | 206/47 |
| 3,883,990 | 5/1975 | Stidolph | 47/58 |
| 3,924,354 | 12/1975 | Gregoire | 47/34.11 |
| 4,053,049 | 10/1977 | Beauvais | 206/318 |
| 4,396,120 | 8/1983 | Morita | 206/460 |
| 4,470,508 | 9/1984 | Yen | 206/334 |
| 5,092,465 | 3/1992 | Weder et al. | 206/423 |
| 5,148,918 | 9/1992 | Weder et al. | 206/423 |
| 5,195,637 | 3/1993 | Weder | 206/423 |
| 5,240,109 | 8/1993 | Weder et al. | 206/423 |
| 5,255,784 | 10/1993 | Weder et al. | 206/423 |
| 5,407,072 | 4/1995 | Weder et al. | 206/423 |

FOREIGN PATENT DOCUMENTS

| | | |
|---|---|---|
| 192843 | 11/1957 | Australia . |
| 2221936 | 10/1974 | France . |
| 4352664 | 12/1992 | Japan . |
| 26878 | 11/1913 | United Kingdom . |

*Primary Examiner*—Jimmy G. Foster
*Attorney, Agent, or Firm*—Dunlap & Codding, P.C.

[57] ABSTRACT

A method for preparing a plant package assembly for delivery to a predetermined location and for transporting the plant package assembly thereto. The plant package assembly comprises a plurality of floral groupings disposed within floral containers. Each floral container is bondingly connected at its base to a support surface by a bonding material disposed on the floral container base, the floral container positioned in a vertical orientation.

45 Claims, 4 Drawing Sheets

METHOD FOR TRANSPORTING FLORAL GROUPINGS

CROSS RELATED REFERENCES

This application is a continuation-in-part of U.S. patent application Ser. No. 08/202,058, titled RETAINING FLAP FOR SHIPPING CARTON, filed Feb. 25, 1994, now U.S. Pat. No. 5,411,137; which is a continuation of U.S. patent application Ser. No. 08/093,109, titled RETAINING FLAP FOR SHIPPING CARTONS, filed Jul. 16, 1993, now U.S. Pat. No. 5,311,992; which is a continuation in part of U.S. patent application Ser. No. 07/892,441, titled SHIPPING CARTON FOR FLORAL GROUPING ASSEMBLIES, filed Jun. 2, 1992, now U.S. Pat. No. 5,240,109; which is a continuation of U.S. patent application Ser. No. 07/831,767, titled SHIPPING CARTON FOR FLORAL GROUPING ASSEMBLIES, filed Feb. 5, 1992, now U.S. Pat. No. 5,148,918; which is a continuation-in-part of U.S. Ser. No. 07/692,329, titled SHIPPING CARTON FOR FLORAL GROUPING ASSEMBLIES, filed Apr, 26, 1991, now U.S. Pat. No. 5,092,465.

BACKGROUND

The present invention is related to methods for transporting plant packages, and to the plant package assemblies prepared for such transportation, particularly wherein the plant packages are connected to a surface for minimizing disturbance of the plant packages.

DESCRIPTION OF THE INVENTION

Figure 1:
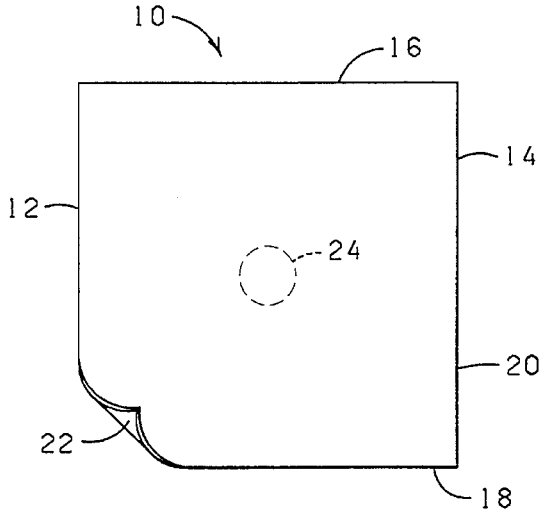
FIG. 1 is a plan view of a sheet of material constructed for use in accordance with the present invention.

The present invention comprises a method for delivering a plant package to a predetermined destination such as a florist shop or grocery store. The method includes the steps of (1) providing a support surface, (2) providing a plurality of plant packages, each plant package comprising a floral container and a floral grouping disposed within the floral container, wherein each floral container has an exterior bottom surface upon which is disposed a connecting bonding material, (3) disposing each plant package on the support surface and causing the bonding material on the exterior bottom surface of the plant package to engage and bondingly connect to the support surface via the connecting bonding material, thereby positioning the plant package in a substantially vertical orientation, and (4) transporting the support surface with the plant packages bondingly connected thereto to the predetermined destination. The plant packages may then be sold, repackaged, or subjected to further processing.

Alternatively, the support surface may further comprise a second connecting bonding material disposed upon a portion thereof for cooperating with the connecting bonding material of the floral container to assist in bondingly connecting the floral container to the support surface.

The connecting bonding material of the floral container and the second connecting bonding material of the support surface are preferably cohesive materials. Preferably, the support surface is the interior bottom surface of a box or carton.

The floral container may be a pot means contained within an external decorative or protective covering such as a flower pot cover. Or, the floral container may be a vase constructed, for example, from a sheet of material and once formed comprises a plurality of overlapping connected folds.

When the floral container is a vase, the vase may further comprise, an upper end, a closed lower end having a bottom, an upper end opening, and a peripheral wall extending from the closed lower end to the upper end, the peripheral wall having an outer surface and an inner surface which encompasses and defines an inner space. The bottom of the closed lower end has an outer surface continuous with the outer surface of the peripheral wall and an inner surface continuous with the inner surface of the peripheral wall, and the peripheral wall preferably comprises a plurality of folds in the sheet of material with adjacent portions of at least some of the folds being connected via a bonding material to form connected folds, which connected folds cooperate to maintain the vase in the shape of a vase.

Further, when the floral container is a vase, the sheet of material may be defined further as being constructed of a material and have a thickness whereby the formed vase is flexible and may be substantially flattened and unflattened to assume the original shape of the formed vase without substantial loss of the preformed shape thereby providing the flexible, yet shape-sustaining nature of the formed vase. The vase may be further defined as being shaped whereby the formed vase includes a skirt extending a distance from the upper end thereof.

Also, when the container is a vase, the plurality of overlapping folds may comprise a substantial number folds which extend at arbitrary angles to a vertical direction and at arbitrary angles to a horizontal direction and extend over different and arbitrary distances. The method may also comprise the additional step of removing the plant packages from the support surface at the predetermined destination. Also, the floral container may further comprise a floral holding material or growth medium disposed within the interior space of the floral container. In other embodiments, the sheet of material may have a label disposed thereon. In addition, the sheet of material may have a bonding material for enabling a label, note, card, or other information delivery means to be attached to the sheet of material. The container may further comprise a release strip for covering the bonding material prior to use of the bonding material to engage a surface.

The sheet of material used to form the container may further comprise a sheet extension which extends from the upper end of the sheet of material after the sheet of material has been formed into a vase. When present, such a sheet extension serves as a protective wrap about a portion of the floral grouping.

The present invention is also drawn to a method for preparing a plant package assembly for transport to a predetermined destination. The method has the steps of (1) providing a support surface, (2) providing a plurality of floral containers, each floral container having an exterior bottom surface upon which is disposed a connecting bonding material, (3) disposing each floral container on the support surface and causing the bonding material on the exterior bottom surface of the floral container to engage and bondingly connect to the support surface via the connecting bonding material, thereby positioning the floral container in a substantially vertical orientation, (4) providing a plurality of floral groupings, and (5) disposing at least a portion of a floral grouping into each floral container, thereby forming a plant package comprising a floral grouping and a floral container, the plant packages and the support surface together comprising the plant package assembly ready for transport to the predetermined destination.

Another version of the invention contemplates the plant package assembly itself which is prepared for transport to a predetermined destination, the assembly comprises a support surface, and a plurality of vertically oriented plant packages which are bondingly connected to the support surface. Each plant package further comprises, a floral container which has an exterior bottom surface upon which is disposed a connecting bonding material for bondingly connecting the floral container to the support surface in a vertical orientation. The floral container is bondingly connected via the connecting bonding material to the support surface such that the floral container is positioned in a substantially vertical orientation. Each plant package also comprises a floral grouping having a stem end. At least a portion of the stem end of the floral grouping is disposed within the floral container. The floral container may have a floral holding material disposed therein.

The invention will be described in more detail below. Shown in FIG. 1 and designated by the general reference numeral 10 is a sheet of material constructed in accordance with the present invention. The sheet 10 has a first outer edge 12, a second outer edge 14, a third outer edge 16, a fourth outer edge 18, a first surface 20 and a second surface 22. A bonding material 24 is disposed upon a portion of the second surface 22, preferably near the center of the second surface 22. The sheet of material 10 may be formed into a container such as the vase designated by the general reference numeral 26 in FIG. 2 by using the method described in U.S. Pat. No. 4,773,182. The vase 26 has an upper end 28, a lower end 30, an outer peripheral surface 32, a plurality of overlapping folds 33 and in general has a floral grouping 34 disposed within the vase 26. The vase 26 in FIG. 2 the bonding material 24 is disposed upon a portion of the lower end 30 of the vase 26. The bonding material 24 may be covered by a release strip (not shown) which covers the surface of the bonding material 24 and which can be removed from the bonding material 24 to expose the bonding material 24 for bondingly connecting to a support surface when desired.

The sheet of material 10 may have a thickness in a range of from about 0.1 mils to about 30 mils. Preferably, the sheet of material 10 has a thickness in a range from about 0.2 mils to about 10 mils. More preferably, the sheet of material 10 has a thickness of from about 0.5 mils to about 5 mils.

Figure 2:
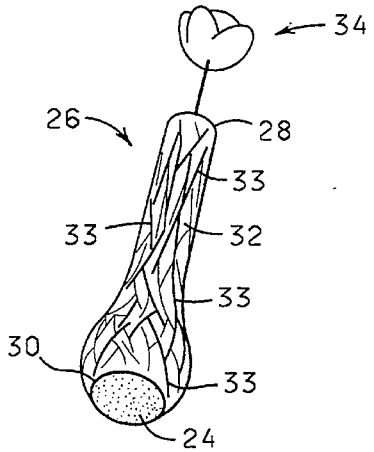
FIG. 2 is an oblique perspective view of a vase for use in accordance with the present invention.

The sheet of material 10 may be any shape and a square or rectangular shape is shown in FIG. 1 only by way of example. The sheet of material 10, may, for example, be square, rectangular, circular or any other geometric shape such as heart-shaped, or any other shape which enhances the function of the sheet for the purpose disclosed herein.

The sheet of material 10 may be constructed of a single layer of material or a plurality of layers of the same or different types of materials. Any thickness of the sheet of material 10 may be utilized in accordance with the present invention as long as the sheet of material 10 is wrappable about a vase, in particular a bud vase, as described herein. The layers of material comprising the sheet of material 10 may be connected together or laminated or may be separate layers.

The sheet of material 10 may be used in conjunction with a second sheet of material (not shown) which may be sized the same or smaller than the sheet 10. If used, the second sheet of material has a thickness in a range from 0.1 mils to about 30 mils and preferably in a range from about 0.2 mils to about 10 mils. The second sheet of material is flexible, but may be somewhat more rigid compared to the first sheet of material 10.

The sheet of material 10 may further comprise a sheet extension which extends from the upper end of the sheet of material after the sheet of material has been formed into a vase wherein the sheet extension (not shown) serves as a protective wrap about the floral grouping.

The vases described herein may be constructed using a method described in U.S. Pat. No. 4,773,182 which is hereby specifically incorporated herein by reference in its entirety. Another method of forming a vase which can be used in accordance with the present invention is described in U.S. Pat. No. 5,176,609 which is hereby incorporated herein in its entirety by reference. A vase thus formed comprises a plurality of overlapping folds which are substantially vertically oriented and are Z-shaped in cross section and wherein the peripheral wall of the container further comprises a plurality of flat panels which comprise substantially no folds.

Other examples of vases formed from sheets of material can be found in the specification of the U.S. patent application titled "Vase for Containing a Floral Grouping", filed by Donald E. Weder on May 13, 1994, under the Express Mail Number TB379042587 U.S., Attorney Docket Number 8401.493, the specification of which is hereby incorporated herein by reference.

By "vase" is meant a vessel, substantially higher than it is wide, which is used to hold a floral grouping or other decoration. More particularly, the height of the vase is generally at least three to five times greater than the narrowest diameter. When used herein the term "bud vase" refers to a vase for holding just one to several cut flowers or buds.

The term "vase" refers to any type of container used for holding a floral grouping or single floral cuttings. "Floral grouping" as used herein means cut fresh flowers, artificial flowers, a single flower either fresh and/or artificial plants or other floral materials and may include other secondary plants and/or ornamentation or artificial or natural materials which add to the aesthetics of the overall floral arrangement. The floral grouping generally comprises a bloom or foliage portion and a stem portion. However, it will be appreciated that the floral grouping may consist of only a single bloom or only foliage (not shown). The term "floral grouping" may be used interchangeably herein with the term "floral arrangement".

The sheet of material 10 and the second sheet of material (if used) may be constructed of a single layer of material or a plurality of layers of the same or different types of materials. Any thickness of the sheet of material 10 may be utilized in accordance with the present invention as long as the sheet of material 10 may be formed into a vase for containing a floral grouping, in the manner described herein.

Additionally, an insulating material such as bubble film, preferable as one of two or more layers, can be utilized in order to provide additional protection for the item contained in the vase.

In a preferred embodiment, the sheet of material 10 is constructed from two polypropylene films laminated together (e.g. a polypropylene film such as Mobil 220 AB clear film laminated to a sheet of Mobil 270 ABW white opaque film). The sheet of material 10 is constructed from any suitable wrapping material that is capable of being formed into a vase for containing a floral grouping. Preferably, the sheet of material 10 comprises a paper (untreated or treated in any manner), cellophane, foil, polymer film, fabric (woven or nonwoven or synthetic or natural), burlap, or combinations thereof. The term "polymer film" means a man-made polymer such as a polypropylene or a naturally occurring polymer such as cellophane. A polymer film is relatively strong and not as subject to tearing (substantially non-tearable), as might be the case with paper or foil.

The sheet of material 10 may vary in color. Further, the sheet of material 10 may consist of designs or decorative patterns which are printed, etched, and/or embossed thereon using inks or other printing materials. An example of an ink which may be applied to the surface of the sheet of material 10 is described in U.S. Pat. No. 5,147,706, entitled "Water Based Ink On Foil And/Or Synthetic Organic Polymer", issued to Kingman on Sep. 15, 1992 and which is hereby incorporated herein by reference. In addition, the sheet of material 10 may have various colorings, coatings, flocking and/or metallic finishes, or other decorative surface ornamentation applied separately or simultaneously or may be characterized totally or partially by pearlescent, translucent, transparent, iridescent or the like, qualities. Each of the above-named characteristics may occur alone or in combination and may be applied to the upper and/or lower surface of the sheet of material 10 or to near the upper end 16 or to near the lower end 18 of the sheet 10. Moreover, each surface of the sheet of material 10 may vary in the combination of such characteristics. The sheet of material 10 itself may be opaque, translucent or partially clear or tinted transparent.

The sheet of material 10 may also be constructed in part, from a cling material. "Cling Wrap or Material" when used herein means any material which is capable of connecting to itself upon contacting engagement during the wrapping process and is wrappable about an item whereby portions of the cling material contactingly engage and connect to other portions of another material, or, alternatively, itself, for generally partially forming a portion of a vase.

The cling material is constructed and treated if necessary, from polyethylene such as Cling Wrap made by Glad®, First Brands Corporation, Danbury, Conn. The cling material will range in thickness from less than about 0.1 mils to about 10 mils, and preferably less than about 0.5 mils to about 2.5 mils and most preferably from less than about 0.6 mils to about 2 mils. However, any thickness of cling material may be utilized in accordance with the present invention which permits the cling material to function as described herein.

Figure 3:
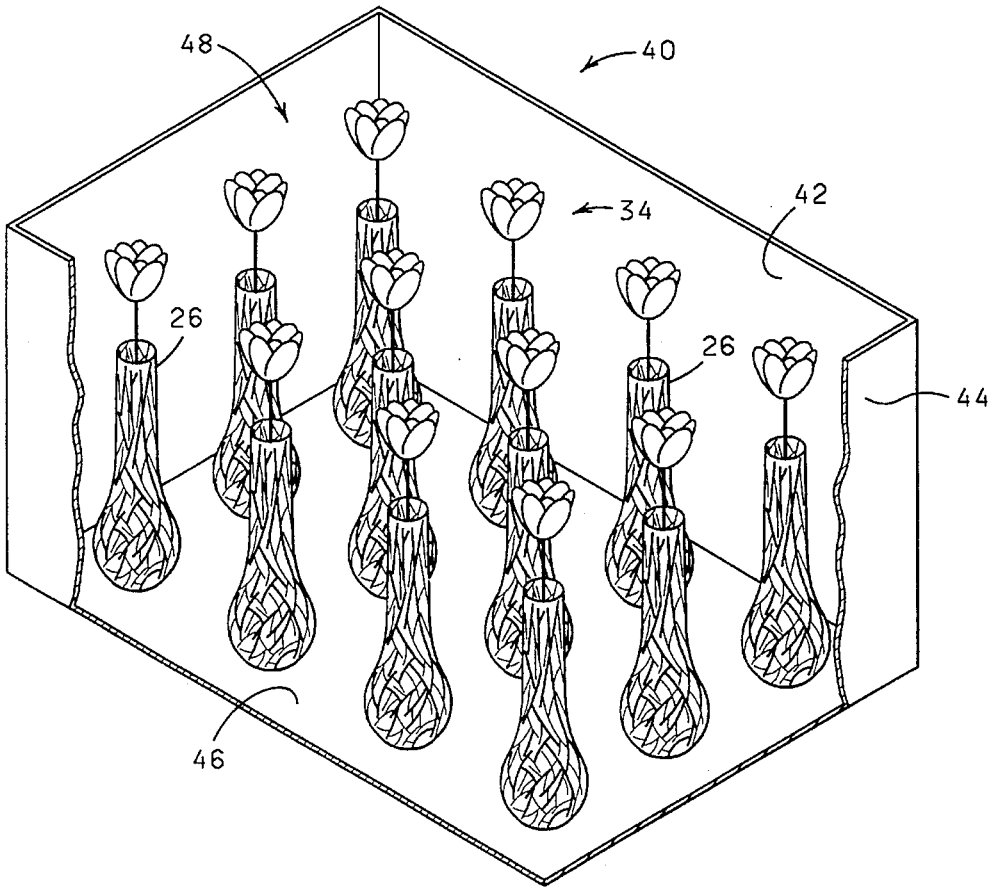
FIG. 3 is a partial cut away view of a carton containing a plurality of vases for transport in accordance with the present invention.

Shown in FIG. 3 is a plurality of vases such as the vase 26 disposed in a vertical orientation within a carton 40. A carton 40 has an inner peripheral side surface 42, an outer peripheral surface 44, an inner bottom surface 46, and an inner retaining space 48 which is defined by the inner peripheral side surface 42 and the inner bottom surface 46. As is seen in FIG. 3 the plurality of vases 26 are connectingly bonded to the inner bottom surface 46 via the connecting bonding material 24 on the bottom surface of the lower end 30 of the vase 26. Each vase 26 then is firmly anchored in an upright vertical orientation upon the surface 46 in the carton 40 via the bonding material 24. It will be appreciated by one of ordinary skill in the art that the vase shapes displayed herein are but a small sample of the great variety of shapes of vases which may be formed to function in accordance with the present invention.

Figure 4:
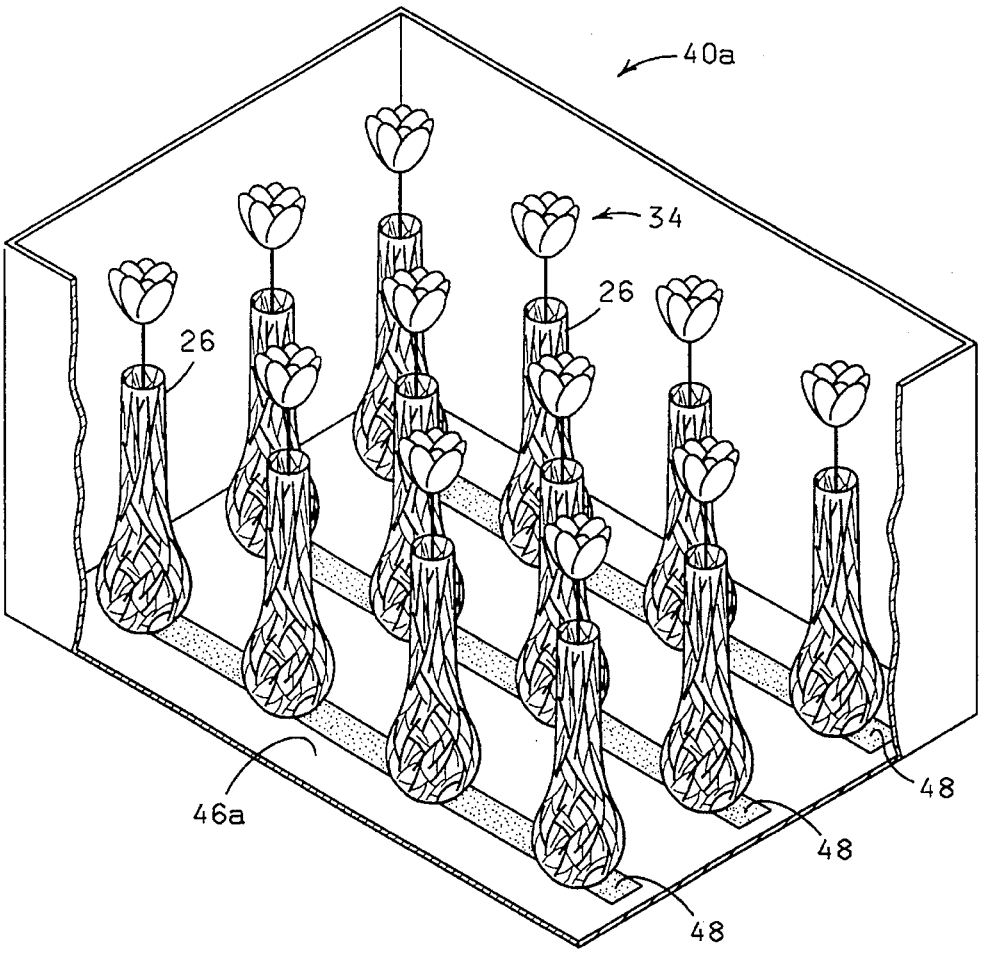
FIG. 4 is a partial cut away view of another carton used in accordance with the present invention.

The plurality of vases 26 with the floral groupings disposed therein are now ready for delivery or shipment to another location. Shown in FIG. 4 and designated by the general reference numeral **40*a* is an alternate version of the container for containing a plurality of floral containers such as the vase 26. The carton 40*a* has a inner bottom surface 46*a* having thereon a plurality of at least one bonding strip 48 for adhering a vase such as vase 26 which is exactly the same as the vase described above except that it does not have a bonding material 24 on the bottom surface thereof. Although the bonding material 48 is shown in FIG. 4 as comprising a continuous strip, the bonding material may instead be disposed upon the support surface 46*a*** in any other geometric form or pattern including spots or designs. One method for disposing a bonding material on the sheet of material, in this case an adhesive or cohesive, is described in U.S. Pat. No. 5,111,637, entitled "Method For Wrapping A Floral Grouping", issued to Weder et al., on May 12, 1992 and which is hereby incorporated herein by reference.

The term "bonding material or bonding means" when used herein means an adhesive, frequently a pressure sensitive adhesive, or a cohesive or any other bonding material which functions as a bonding material in accordance with the invention described herein. When the bonding material is a cohesive, a similar cohesive material must be present on the surface which the vase will be disposed on to be bondingly contacted and bondingly connected with the cohesive material.

Figure 5:
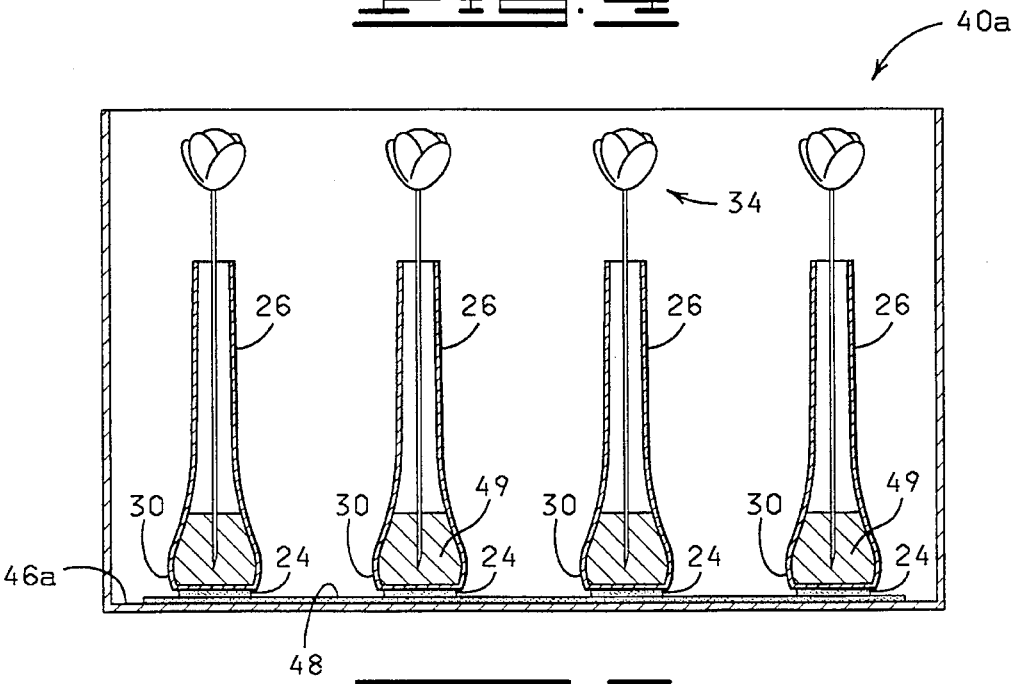
FIG. 5 is a side sectional view of a plurality of vases bondingly connected to a support surface of a carton.

Shown in FIG. 5 is an example of a carton **40*a* which is exactly the same as the carton 40*a* described in FIG. 4 except that the strip of bonding material 48 on the inner bottom surface 46a is not an adhesive but is a cohesive material which cohesively binds or bonds to a cohesive material defined as the bonding material 24 on the lower surface on each of the vases 26 disposed in the carton 40*a***.

A floral holding medium (such as foam) 49 is shown disposed within the inner space of the vase 26 and functions to hold a portion of the floral grouping 34, for providing moisture or nutrients, or for providing additional weight to the vase 26 described herein to counterbalance the floral grouping 34. The floral holding medium 49 may further comprise a growing medium for extending the life of the floral grouping 34 disposed within the inner space of the vase 26. Such floral holding materials 49 are well known to those of ordinary skill in the art and are commercially available.

The floral grouping 34 generally comprises a bloom portion and a stem portion. Further, the floral grouping 34 may comprise a root portion (not shown) as well. However, it will be appreciated that the floral grouping may consist of only a single bloom or only foliage, or a botanical item (not shown), or a propagule (not shown). The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores. The floral holding material 49 is added to the vase after the vase has been constructed.

Figure 6:
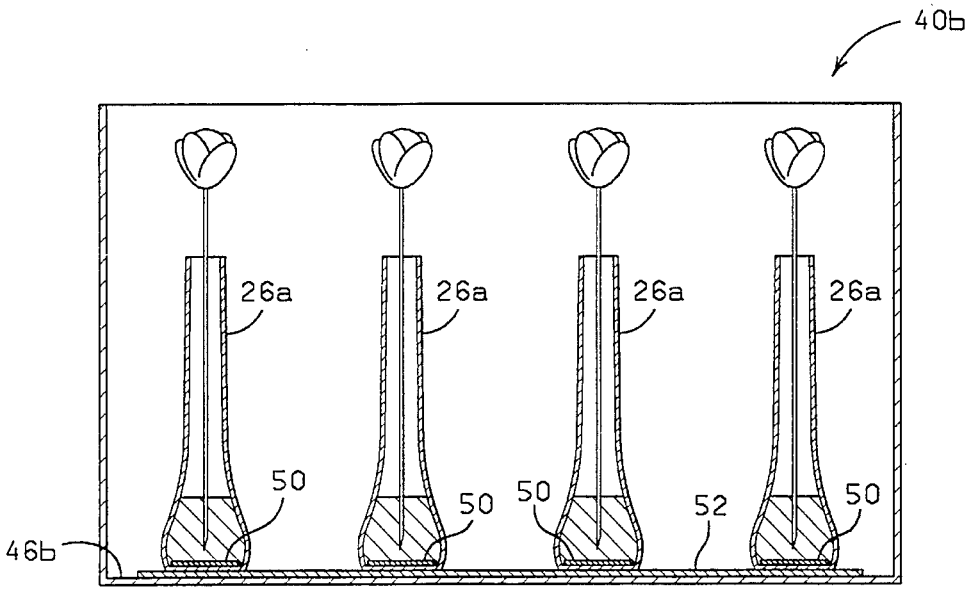
FIG. 6 is a side sectional view of a plurality of vases magnetically adhered to a support surface of a carton.
Figure 7:
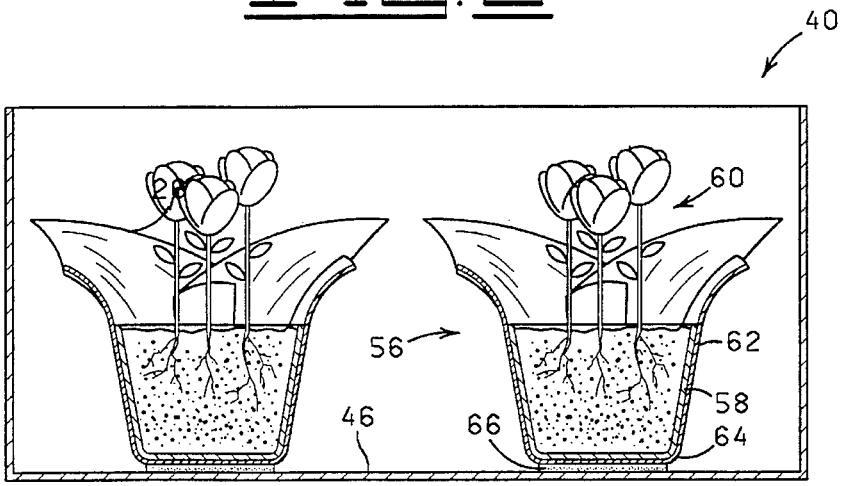
FIG. 7 is a side sectional view of a plurality of flower pots bondingly connected to a support surface.

FIG. 6 shows another version of the carton, the carton designated therein by the general reference numeral 40*b*. The carton 40*b* has an inner bottom surface 46*b*. Shown in FIG. 6 is a vase designated by the general reference numeral 26*a* which has a metallic plate or strip disposed on the inner bottom surface 46*b* of the vase 26*a*. An example of a magnetic strip is that which is commercially available and which has an adhesive backing for attaching to a surface. Also disposed on the inner bottom surface 46*b* is a metallic strip 52. It can be seen in the FIG. 6 then that each vase 26*a* is disposed in a vertical position wherein the magnetic plate 50 of the vase 26*a* magnetically engages the magnetic strip 52 of the surface 46*b* for maintaining the vase 26*a* in a vertical orientation optimal for delivery. It will be understood by one of ordinary skill in the art that any number of types of floral containers may be anchored in a carton using the technology discussed herein. For example, shown in FIG. 7 is plant package 56 comprising a plant cover such as that designated by the general reference numeral 62 covers a potted plant 58 having disposed therein a floral grouping 60. Disposed on the bottom end 64 of the plant cover 62 is a bonding material 66 for enabling the plant package 56 to be adhesively or bondingly engaged to the inner bottom surface 46 of the carton 40 for ease of transport.

Figure 8:
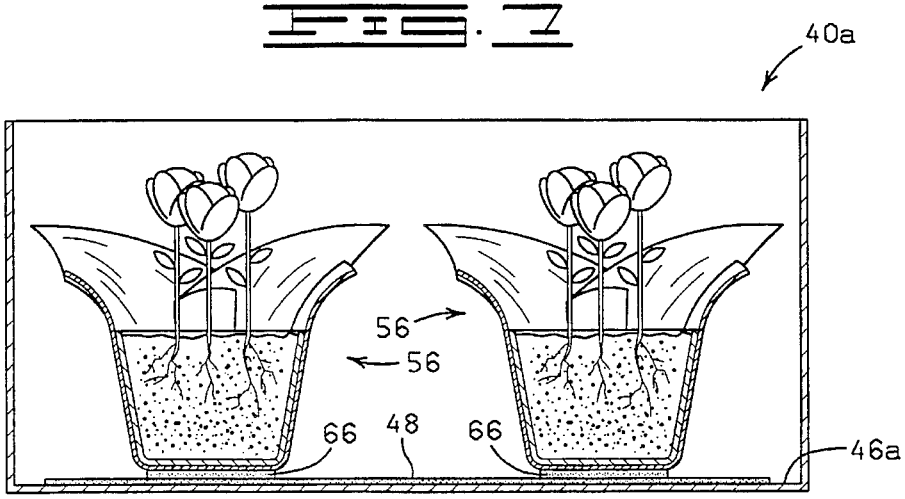
FIG. 8 is a side sectional view of a plurality of flower pots connected to a support surface in an alternate manner.

Shown in FIG. 8 is a carton which is exactly the same as the carton 40*a* described in FIG. 4 showing a plant package 56 similar to the plant package 56 of FIG. 7 but which has disposed on the lower surface thereof a bonding material 66 which comprises a cohesive material for bonding to a cohesive material 48 which is disposed upon the inner bottom surface 46*a* of the carton 40*a*.

Figure 9:
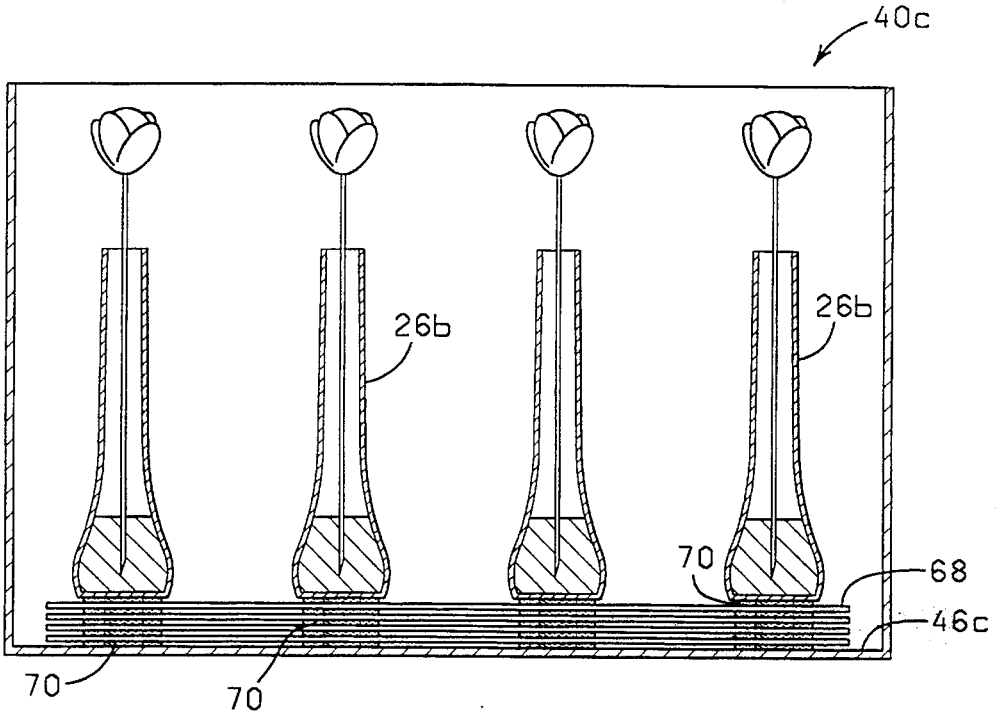
FIG. 9 is a side sectional view of an alternate version of the support surface of the present invention.

In an alternative embodiment of the present invention shown in FIG. 9, a carton 40*c* comprises a plurality of sheets 68 which have disposed thereon a plurality of portions of bonding material 70 which may be an adhesive for causing the bonding of a floral container such as the floral container 26*b* shown in the FIG. 9 for maintaining the floral container in a vertical orientation during delivery or shipment.

After one or more usages of the bonding material on the sheet 68, the sheet 68 may be removed from the carton thus revealing a fresh sheet 68 with fresh bonding material 70 which has not been used thereby free of various accumulated materials which may affect the bonding ability of the bonding material 70, and thereby its ability to maintain the vases in a vertical orientation.

Figure 10:
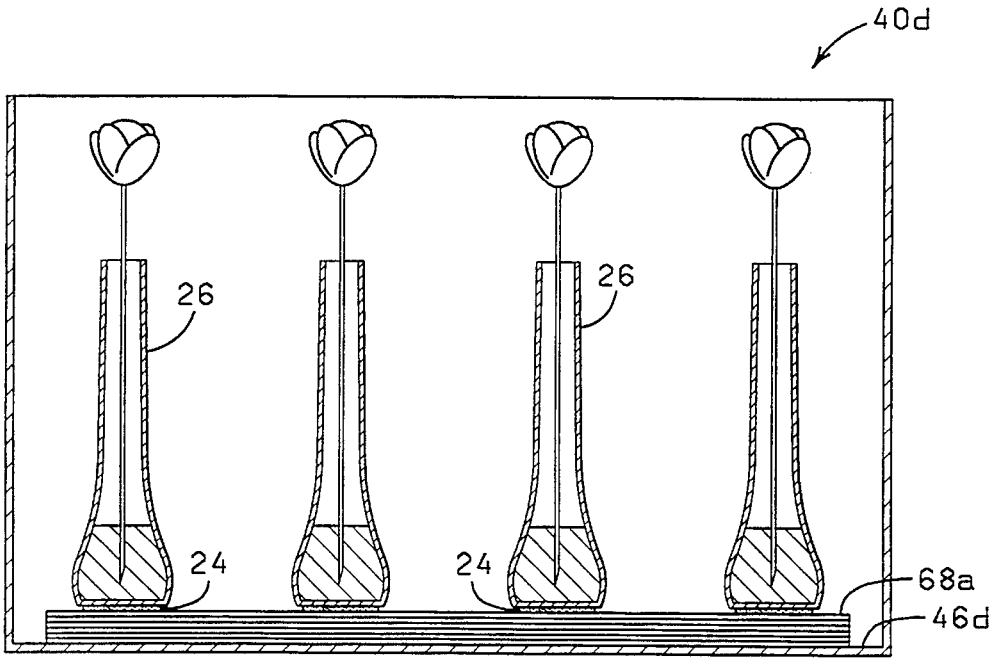
FIG. 10 is a side sectional view of yet another version of the support surface of the present invention.

Shown in FIG. 10 is an alternative version of the carton designated by the general reference numeral 40*d*. The carton 40*d* has disposed upon the inner bottom surface 46*d* a plurality of sheets of material 46*a*. None of the sheets of material have bonding material disposed thereon for bonding to floral containers disposed within the carton. However, the carton 40*d* can be used to contain a plurality of containers such as those shown as FIG. 2 having a bonding material 24 disposed upon the bottom surface of the floral container 26. A number of floral containers 26 can thus be shipped and vertically stored in the container 40*d*. Once each sheet 68*a* has been soiled or otherwise rendered inoperable, the upper sheet 68*a* can be removed revealing a fresh sheet for use in storing and shipping the floral containers 26.

Changes may be made in the construction and the operation of the various components, elements and assemblies described herein or in the steps or the sequence of steps of the methods described herein without departing from the spirit and scope of the invention as defined in the following claims.

What is claimed is:

1. A method for delivering a plant package to a predetermined destination, comprising:

providing a support surface;

providing a plurality of plant packages, each comprising a floral container and a floral grouping disposed within the floral container, the floral container having an exterior bottom surface upon which is disposed a connecting bonding material;

disposing each plant package on the support surface causing the bonding material on the exterior bottom surface of the plant package to engage and bondingly connect to the support surface via the connecting bonding material, thereby positioning the plant package in a substantially vertical orientation; and transporting the support surface with the plant packages bondingly connected thereto to the predetermined destination.

2. The method of claim 1 wherein in the step of providing the support surface, the support surface further comprises a second connecting bonding material disposed upon a portion thereof for cooperating with the connecting bonding material of the floral container to bondingly connect the floral container to the support surface.

3. The method of claim 2 wherein in the step of providing the plant packages, the connecting bonding material of the floral container and the second connecting bonding material of the support surface are cohesive materials.

4. The method of claim 1 wherein in the step of providing the plant packages, the connecting bonding material is an adhesive.

5. The method of claim 1 wherein in the step of proving a support surface, the support surface is the interior bottom surface of a box or carton.

6. The method of claim 1 wherein in the step of providing the plant packages, the floral container is a pot means contained within an external decorative or protective covering.

7. The method of claim 1 wherein in the step of providing the plant packages, the floral container is a vase constructed from a sheet of material and which has a plurality of overlapping connected folds.

8. The method of claim 7 wherein the vase further comprises an upper end, a closed lower end having a bottom, an upper end opening, and a peripheral wall extending from the closed lower end to the upper end, the peripheral wall having an outer surface and an inner surface which encompasses and defines an inner space and wherein the bottom of the closed lower end has an outer surface continuous with the outer surface of the peripheral wall and an inner surface continuous with the inner surface of the peripheral wall, and wherein the peripheral wall comprises a plurality of folds in the sheet of material with adjacent portions of at least some of the folds being connected via a bonding material to form connected folds, which connected folds cooperate to maintain the vase in the shape of a vase.

9. The method of claim 7 wherein the sheet of material used to form the vase is defined further as being constructed of a material and having a thickness whereby the formed vase is flexible and may be substantially flattened and unflattened to assume the original shape of the formed vase without substantial loss of the preformed shape thereby providing the flexible, yet shape-sustaining nature of the formed vase.

10. The method of claim 7 wherein the sheet of material used to form the vase is defined further as being shaped whereby the formed vase includes a skirt extending a distance from the upper end thereof.

11. The method of claim 7 wherein the plurality of overlapping folds in the vase comprise a substantial number folds which extend at arbitrary angles to a vertical direction and at arbitrary angles to a horizontal direction and extend over different and arbitrary distances.

12. The method of claim 7 wherein the vase comprises a plurality of overlapping folds which are substantially vertically oriented and are Z-shaped in cross section and wherein the peripheral wall further comprises a plurality of flat panels which comprise substantially no folds.

13. The method of claim 7 wherein the sheet of material used to form the vase is defined further as having a thickness in a range from less than about 0.1 mils to about 30 mils.

14. The method of claim 7 wherein the sheet of material used to form the vase is defined further as having a thickness in a range from less than about 0.2 mils to about 10 mils.

15. The method of claim 7 wherein the sheet of material used to form the vase is defined further as having a thickness in a range from less than about 0.5 mils to about 5 mils.

16. The method of claim 7 wherein the container further comprises a release strip for covering the bonding material prior to use of the bonding material to engage a surface.

17. The method of claim 7 wherein the sheet of material used to form the vase is selected from the group consisting of a paper (untreated or treated in any manner), cellophane, foil, polymer film, fabrics (woven or nonwoven, synthetic or natural), burlap, or combinations thereof.

18. The method of claim 7 wherein the sheet of material used to form the vase further comprises a sheet extension which extends from the upper end of the sheet of material after the sheet of material has been formed into a vase, the sheet extension for serving as a protective wrap about a portion of the floral grouping.

19. The method of claim 1 comprising the additional step of removing the plant packages from the support surface at the predetermined destination.

20. The method of claim 1 wherein in the step of providing the plant packages, the floral container further comprises a floral holding material or growth medium disposed within an interior space of the floral container.

21. The method of claim 1 wherein the container further comprises a label disposed thereon.

22. The method of claim 1 wherein the container further comprises a bonding material for enabling a label, note, card, or other information delivery means to be attached to the sheet of material.

23. The method of claim 1 wherein the container is further defined as a bud vase for containing one bud or flower.

24. The method of claim 1 wherein the bonding material is further defined as an adhesive or cohesive.

25. A method for preparing a plant package assembly for transport to a predetermined destination, comprising:

providing a support surface;

providing a plurality of floral containers, each floral container having an exterior bottom surface upon which is disposed a connecting bonding material;

disposing each floral container on the support surface and causing the bonding material on the exterior bottom surface of the floral container to engage and bondingly connect to the support surface via the connecting bonding material, thereby positioning the floral container in a substantially upright orientation;

providing a plurality of floral groupings; and disposing at least a portion of a floral grouping into each floral container, thereby forming a plant package comprising a floral grouping and a floral container, the plant packages and the support surface together comprising the plant package assembly ready for transport to the predetermined destination.

26. The method of claim 25 comprising the additional step of transporting the plant package assembly to the predetermined destination.

27. The method of claim 25 wherein in the step of providing the plant packages, the floral container further comprises a floral holding material or growth medium disposed within an interior space of the floral container.

28. The method of claim 25 wherein in the step of providing the support surface, the support surface further comprises a second connecting bonding material disposed upon a portion thereof for cooperating with the connecting bonding material of the floral container to bondingly connect the floral container to the support surface.

29. The method of claim 28 wherein the connecting bonding material of the floral grouping and the second connecting bonding material of the support surface is a cohesive.

30. The method of claim 25 wherein the connecting bonding material is an adhesive.

31. The method of claim 25 wherein in the step of proving a support surface, the support surface is the bottom surface of a box or carton.

32. The method of claim 25 wherein the floral container is a pot means contained within an external decorative or protective covering.

33. The method of claim 25 wherein the floral container is a vase constructed from a sheet of material and which has a plurality of overlapping connected folds.

34. The method of claim 33 wherein the vase further comprises an upper end, a closed lower end having a bottom, an upper end opening, and a peripheral wall extending from the closed lower end to the upper end, the peripheral wall having an outer surface and an inner surface which encompasses and defines an inner space and wherein the bottom of the closed lower end has an outer surface continuous with the outer surface of the peripheral wall and an inner surface continuous with the inner surface of the peripheral wall, and wherein the peripheral wall comprises a plurality of folds in the sheet of material with adjacent portions of at least some of the folds being connected via a bonding material to form connected folds, which connected folds cooperate to maintain the vase in the shape of a vase.

35. The method of claim 33 wherein the vase further comprises a plurality of overlapping folds which are substantially vertically oriented and are Z-shaped in cross section and wherein the peripheral wall further comprises a plurality of flat panels which comprise substantially no folds.

36. The method of claim 25 comprising the additional step of removing the plant packages from the support surface at the predetermined destination.

37. A plant package assembly prepared for transport to a predetermined destination, comprising:

a support surface; and a plurality of vertically oriented plant packages which are bondingly connected to the support surface, each plant package comprising:

a floral container having an exterior bottom surface upon which is disposed a connecting bonding material for bondingly connecting the floral container to the support surface, the floral container bondingly connected via the connecting bonding material to the support surface such that the floral container is positioned in a substantially upright orientation, and a floral grouping having a stem end and a bloom end, wherein at least a portion of the stem end of the floral grouping is disposed within the floral container, thereby forming the plant package comprising a floral grouping and a floral container.

38. The assembly of claim 37 wherein the floral container further comprises a floral holding material or growth medium disposed within an interior space of the floral container.

39. The assembly of claim 37 wherein the support surface further comprises a second connecting bonding material disposed upon a portion thereof for cooperating with the connecting bonding material of the floral container to bondingly connect the floral container to the support surface.

40. The assembly of claim 39 wherein the connecting bonding material of the floral container and the second connecting bonding material of the support surface is a cohesive.

41. The assembly of claim 37 wherein the connecting bonding material is an adhesive.

42. The assembly of claim 37 wherein the support surface is the bottom surface of a box or carton.

43. The assembly of claim 37 wherein the floral container is a pot means contained within an external decorative or protective covering.

44. The assembly of claim 37 wherein the floral container is a vase constructed from a sheet of material and which has a plurality of overlapping connected folds.

45. The assembly of claim 44 wherein the vase further comprises:

an upper end having an opening, a closed lower end having a bottom, and a peripheral wall extending from the closed lower end to the upper end, the peripheral wall having an outer surface and an inner surface which encompasses and defines an inner space and wherein the bottom of the closed lower end has an outer surface continuous with the outer surface of the peripheral wall and an inner surface continuous with the inner surface of the peripheral wall, and wherein the peripheral wall comprises a plurality of folds in the sheet of material with adjacent portions of at least some of the folds being connected via a bonding material to form connected folds which cooperate to maintain the vase in the shape of a vase.

* * * * *

UNITED STATES PATENT AND TRADEMARK OFFICE

CERTIFICATE OF CORRECTION

PATENT NO. : 5,564,567

DATED : October 15, 1996

INVENTOR(S) : Donald E. Weder

It is certified that error appears in the above-identified patent and that said Letters Patent is hereby corrected as shown below:

Cover Sheet, under Section '[73] Assignees:', line 2, please delete "both".

Column 1, line 8, please delete "CARTON", and substitute therefor --CARTONS--.

Column 5, line 41, please delete "16", and substitute therefor --28--.

Column 5, line 42, please delete "18", and substitute therefor --30--.

Column 8, line 2, please delete "46a", and substitute therefor --68a--.

Signed and Sealed this

Twenty-seventh Day of May, 1997

*Attest:*

Bruce Lehman

BRUCE LEHMAN

*Attesting Officer*

*Commissioner of Patents and Trademarks*